US009301348B2

(12) United States Patent
Saes et al.

(10) Patent No.: US 9,301,348 B2
(45) Date of Patent: Mar. 29, 2016

(54) LED DRIVER FOR POWERING AN LED UNIT FROM A ELECTRONIC TRANSFORMER

(75) Inventors: Marc Saes, Eindhoven (NL); Petrus Johannes Maria Welten, Oss (NL)

(73) Assignee: ELDOLAB HOLDING B.V., Son En Breugel (NL)

( * ) Notice: Subject to any disclaimer, the term of this patent is extended or adjusted under 35 U.S.C. 154(b) by 448 days.

(21) Appl. No.: 13/508,469

(22) PCT Filed: Nov. 2, 2010

(86) PCT No.: PCT/NL2010/050730

§ 371 (c)(1), (2), (4) Date: May 7, 2012

(87) PCT Pub. No.: WO2011/056068

PCT Pub. Date: May 12, 2011

(65) Prior Publication Data

US 2012/0229041 A1 Sep. 13, 2012

Related U.S. Application Data

(60) Provisional application No. 61/258,277, filed on Nov. 5, 2009.

(51) Int. Cl.
*H05B 37/02* (2006.01)
*H05B 33/08* (2006.01)

(52) U.S. Cl.
CPC ..... *H05B 33/0815* (2013.01); *H05B 33/083* (2013.01)

(58) Field of Classification Search
CPC ..... H05B 37/02
USPC ..... 315/200 R, 276, 291
See application file for complete search history.

(56) References Cited

U.S. PATENT DOCUMENTS

| | | | | |
|---|---|---|---|---|
| 5,786,670 | A * | 7/1998 | Nguyen | 315/200 R |
| 5,930,130 | A * | 7/1999 | Katyl et al. | 363/53 |
| 6,690,250 | B2 * | 2/2004 | Møller | 333/181 |
| 6,737,845 | B2 * | 5/2004 | Hwang | 323/284 |
| 8,299,773 | B2 * | 10/2012 | Jang et al. | 323/299 |
| 8,344,646 | B2 * | 1/2013 | Xue et al. | 315/291 |
| 8,680,783 | B2 * | 3/2014 | Athalye | 315/294 |
| 8,749,163 | B2 * | 6/2014 | Phadke | 315/291 |
| 8,922,135 | B2 * | 12/2014 | Sumitani | H05B 33/0815 315/201 |

(Continued)

FOREIGN PATENT DOCUMENTS

| | | | |
|---|---|---|---|
| WO | 0105193 | A1 | 1/2001 |
| WO | 2009055821 | A1 | 4/2009 |

*Primary Examiner* — Jimmy Vu
*Assistant Examiner* — Wei Chan
(74) *Attorney, Agent, or Firm* — Browdy and Neimark, P.L.L.C.

(57) ABSTRACT

An LED driver comprising a power converter for powering an LED unit and a control unit for controlling the power converter is provided. The power converter comprising an input terminal for receiving a rectified AC supply voltage, and an output terminal for supplying a current to the LED unit, and the control unit comprising —an input for receiving a supply signal representative of the supply voltage and —an output for providing a control signal to the power converter The control unit is further arranged to: —determine the control signal for controlling the power converter based on the supply signal, and —control the power converter to supply the current to the LED unit based on the control signal, the current being amplitude modulated in synchronism or in phase with the rectified AC supply voltage.

19 Claims, 9 Drawing Sheets

(56) References Cited

U.S. PATENT DOCUMENTS

| | | | | |
|---|---|---|---|---|
| 2003/0098742 | A1* | 5/2003 | Nakagawa et al. | 327/551 |
| 2003/0123203 | A1* | 7/2003 | Telefus et al. | 361/58 |
| 2005/0231133 | A1* | 10/2005 | Lys | 315/291 |
| 2006/0014573 | A1* | 1/2006 | Wuidart | 455/572 |
| 2006/0250117 | A1* | 11/2006 | Rayburn | 323/209 |
| 2007/0217093 | A1* | 9/2007 | Xue et al. | 361/18 |
| 2008/0116818 | A1* | 5/2008 | Shteynberg et al. | 315/192 |
| 2008/0197786 | A1* | 8/2008 | Schaible et al. | 315/224 |
| 2008/0224629 | A1* | 9/2008 | Melanson | 315/247 |
| 2009/0212721 | A1 | 8/2009 | Maruyama | |
| 2009/0251934 | A1* | 10/2009 | Shteynberg et al. | 363/81 |
| 2010/0026208 | A1* | 2/2010 | Shteynberg et al. | 315/297 |
| 2010/0207536 | A1* | 8/2010 | Burdalski et al. | 315/224 |
| 2010/0270942 | A1* | 10/2010 | Hui et al. | 315/291 |
| 2011/0080102 | A1* | 4/2011 | Ge et al. | 315/200 R |
| 2011/0148313 | A1* | 6/2011 | Ramaker | 315/185 R |
| 2012/0139422 | A1* | 6/2012 | Ren et al. | 315/126 |
| 2012/0153866 | A1* | 6/2012 | Liu | 315/294 |
| 2012/0169246 | A1* | 7/2012 | Eddeane et al. | 315/276 |

* cited by examiner

LED DRIVER FOR POWERING AN LED UNIT FROM A ELECTRONIC TRANSFORMER

FIELD OF THE INVENTION

The present invention relates to LED based lighting applications, in particular to lighting applications that are powered from an electronic transformer and/or TRIAC dimmer. Such an arrangement is often encountered in a retrofit situation whereby a conventional halogen light is replaced by an LED unit while a power converter such as an electronic transformer is maintained.

BACKGROUND ART

In general, LED based lighting applications (also referred to as LED units, comprising one or more light emitting diodes (LEDs)) are powered by an LED driver (e.g. comprising a switched mode power supply such as a Buck or Boost converter) which is supplied from a DC voltage source. In such an arrangement, dimming of the light (in response to a user interface action) is typically realised by adjusting the duty cycle of the LED or LEDs of the application. As such, conventional LED drivers are not suited for being powered by a voltage source which differs from a DC voltage source, such as e.g. provided by an electronic transformer or a standard TRIAC dimmer. When an LED driver is supplied from a varying voltage source, the instantaneous voltage available as input to the LED driver may be momentarily insufficient to power the LED or LEDs of the lighting application. This could result in flicker of the lighting application which could result into a range of effects in an observer, from awkwardness via irritation to nausea.

When such a varying voltage source such as an electronic transformer or a TRIAC dimmer is used to power a normal halogen light, the power received will be averaged out and will not result in flicker, although even with halogen lights, the low output levels are cumbersome and flicker can be seen in many cases.

In case a lighting application is powered from an electronic transformer, it is further required to, in order for the electronic transformer to provide an output voltage for supplying the LED unit, maintain a current as provided by the transformer above a certain level. As such, when the supply current (i.e. the current supplied to the LED driver) is insufficient, the electronic transformer will cease to provide an output voltage. Subsequently, the electronic transformer will, after a certain amount of time, attempt to resume its proper operation. Meanwhile however, the light output of the LED unit could be interrupted, whereas a continuous light output would be desired. In order to ensure proper operation of the electronic transformer, it has been proposed in literature to provide a load in parallel to the LED driver in order to ensure that a minimum supply current is being supplied by the electronic transformer. Maintaining such a current may result in an important dissipation, adversely affecting the efficiency of the lighting application.

Ensuring that a sufficiently high supply current is provided by an electronic transformer powering one or more LED drivers, is rendered even more difficult because of the high power to light conversion of LED based lighting applications, compared to conventional halogen lights. As will be understood, when a 20 W halogen light bulb is replaced by a 5 W LED unit, the power to be supplied by the electronic transformer can be reduced significantly and may result in a supply current insufficient for proper operation of the electronic transformer.

In view of the above, it is an object of the present invention to facilitate the powering of LED based lighting applications by an electronic transformer (optionally preceded by a TRIAC based dimmer), thereby facilitating conventional applications such as halogen lights to retrofit with LED based lighting application.

SUMMARY OF THE INVENTION

According to an aspect of the invention, there is provided an LED driver comprising

- a power converter for powering an LED unit;
- a control unit for controlling the power converter;
- the power converter comprising
  - an input terminal for receiving a rectified AC supply voltage, and
  - an output terminal for supplying a current to the LED unit,
- the control unit comprising
  - an input for receiving a supply signal representative of the supply voltage and
  - an output for providing a control signal to the power converter, whereby
- the control unit is arranged to:
  - determine the control signal for controlling the power converter based on the supply signal, and
  - control the power converter to supply the current to the LED unit based on the control signal, the current being amplitude modulated in synchronism or in phase with the rectified AC supply voltage.

The LED driver according to the invention comprises a power converter, such as a Buck, Boost or hysteretic converter and a control unit (e.g. a controller or microprocessor) for controlling the power converter. In accordance with the invention, the control unit controls the power converter by providing a control signal to the power converter, the control signal being based on a supply signal that is received at an input of the control unit.

The control signal may further, in an embodiment, be based on a set-point (e.g. representing a required intensity or colour setting), e.g. received via RF or any other communication means.

In accordance with the invention, the supply signal represents the supply voltage that is supplied to the power converter. As such, the supply signal can e.g. be a signal that is proportional to the supply voltage (e.g. obtained via an ND conversion of the supply voltage). The supply signal can be derived or retrieve at various positions, e.g. at the output terminal of the electronic transformer, after a rectification of the transformer's output voltage, at the input terminals of the LED driver, . . . . In accordance with the invention, the control unit is arranged to control the power converter in such manner that an LED unit, in use powered by the LED driver, is not provided with a substantially constant current, rather, the LED unit is, in use, provided with a current with varying amplitude, the amplitude variation (or modulation) being in synchronism or in phase with the supply voltage, in use, a rectified AC voltage. By modulating the current as supplied to the LED driver as stated, it has been observed that, when the rectified AC supply voltage originates from an electronic transformer, the electronic transformer can more easily sustain the supply voltage. It has thus been found that, in order to ensure that an electronic transforms keeps providing an output voltage, it is not required to maintain the current supplied to the LED unit at a constant comparatively high value in order to sustain the electronic transformer. Rather it has been found sufficient to provide a comparatively high current to the LED unit when the supply voltage is comparatively high. As such, an amplitude modulation of the current provided to the LED unit in synchronism with the rectified AC supply voltage facilitates the power source (e.g. an electronic transformer and/or a TRIAC dimmer) in providing an output voltage used for generating the supply voltage of the LED driver. In an embodiment, the current as provided to the LED unit is arranged to vary in phase with the rectified AC voltage.

Assuming a rectified AC voltage having a main frequency component of 100 Hz, (e.g. obtained by transforming and rectifying an AC mains supply of 230 V, 50 Hz), it has been found sufficient, for most electronic transformers, to ensure that the current as supplied by the transformer comprises a 100 Hz component (or a multiple thereof) substantially in phase with the main frequency component of the rectified AC voltage. As the power supplied to an LED unit can be approximated to be proportional to the current through the LED unit, the average power supplied to the LED unit can be substantially smaller than the peak power which is supplied when the current supplied is at its peak value.

In an embodiment, the LED driver further comprises a rectifier arranged to receive an AC supply voltage and provide the rectified AC voltage to the input terminal. The AC supply voltage can e.g. be provided by an electronic transformer or a TRIAC dimmer modulating an AC supply voltage, or a combination thereof.

In an embodiment, the LED driver further comprises an energy storage element connectable to the input terminal and a switch for connecting and disconnecting the energy storage element to the input terminal, the switch being controlled by the control unit, based on the input signal. As an example, such an energy storage element can comprise a capacitor or an assembly of capacitors which can be charged (by the supply voltage) and discharged (towards the LED driver) when the switch is operated at appropriate instances.

The application of such an energy storage element can improve the performance in different ways. As the energy storage element is charged from the rectified AC voltage, e.g. originating from an electronic transformer, the charging current increases the instantaneous current demand of the LED driver which can thus facilitate sustaining an electronic transformer. The energy storage element can further improve the LED driver's performance by applying it as a power source when the supply voltage is comparatively low.

As will acknowledged by the skilled person, in order to provide a current to an LED unit, a minimal voltage (known as the forward voltage Vf) is required in order to provide a current to the LED unit. Depending on the type of power converter applied, supplying such a minimal voltage at the output terminal of the power converter may equally require a minimal voltage at the input terminal of the power converter. When this voltage is not available, the power converter cannot supply the required current to the LED unit. However, in case e.g. a charged capacitor (e.g. charged to a voltage level corresponding to the peak value of the rectified AC voltage) would be available, this capacitor could be applied, temporarily, as a supply source, thereby improving the current supply towards the LED unit. In the absence of an energy storage element that can be applied as a temporary power source, the current supplied to the LED unit could reduce to zero during part of the period of the rectified AC supply voltage. Depending on the main frequency of the supply voltage, this could be observed by a user or could even result in the user experiencing nausea. The application of an energy storage element as described also enables to adjust the frequency content of the current supplied to the LED unit, thereby mitigating any adverse effects such as flicker. In case a comparatively large amplitude modulation would be required to sustain an electronic transformer to provide the supply voltage, this could e.g. result in the current provided to the LED unit comprising a comparatively large 100 Hz component. Such an 100 Hz component could be undesired for certain observers. By applying an energy storage element for providing a current to the LED unit when the supply voltage is comparatively low, the frequency content of the current to the LED unit can be altered. By introducing current peaks (e.g. by discharging a charged capacitor) when the supply voltage is comparatively low, the main frequency component of the current supplied to the LED unit can become a 200 Hz current instead of a 100 Hz current. In general, due to the application of the switchable capacitor (in general, the energy storage element), which can be applied as a voltage source when the rectified AC voltage is comparatively low, a current component at twice the main frequency of the rectified AC voltage (e.g. a 200 Hz current in case the rectified AC voltage originates from a 50 Hz mains supply) can be introduced in the current as supplied to the LED unit. By doing so, adverse effects such as an observable flicker or nausea can be reduced significantly.

In addition to (or as an alternative to) the application of an energy storage device, the LED driver according to the invention can be provided with a power factor correction device. Various embodiments of such a power factor correction device are discussed in more detail below. In an embodiment, the power factor correction device can be applied as an energy storage device, e.g. comprising one or more capacitances.

In an embodiment, the power factor correction device can be connected and disconnected from the input terminal via a switch that is controlled by the control unit of the LED driver, e.g. in accordance with the supply signal. Connecting and disconnecting the power factor correction device can thus be synchronised with the rectified AC supply voltage.

The control unit of the LED driver according to the invention can, in an embodiment, be arranged to determine a minimum value for the amplitude modulation in order to sustain the supply voltage. This can e.g. be done by starting with a comparatively large amplitude modulation, gradually reducing the amplitude modulation applied to the current, monitor if the supply voltage is sustained, and, if the supply voltage is no longer sustained, gradually increase the amplitude modulation until the supply voltage is sustained again.

By doing so, the current variation, and any possible adverse effects of it, can be reduced to a minimum while sustaining the electronic transformer.

In this respect, it is worth noting that the required amplitude modulation (required to sustain an electronic transformer supplying the LED driver) can depend on the total load to be powered by the transformer. In case a single transformer is used to provide a supply voltage to a plurality of LED drivers, the required amplitude modulation can be comparatively small or even zero, compared to the case whereby the transformer only supplies a single LED driver.

With respect to maintaining an electronic transformer to supply an output voltage, it is worth noting that the amplitude modulation required to sustain the transformer, may depend on the maximum amplitude of the supply voltage as provided. As will be understood by the skilled person, this maximum amplitude may vary in time, e.g. due to load changes in the electric grid supplying the electronic transformer. As such, it may be required to increase the amplitude modulation or the amplitude of the current profile as provided to the LED driver, when the supply voltage maximum amplitude increases, in order to sustain the electronic transformer. As in general, there is a limited number of current levels available that can be selected (e.g. 16 current levels ranging from zero to 120% of the nominal current). If the level of the current supplied to the LED unit would be raised by one level, such a change would become visible to an observer. Instead of applying such a sudden current increase, it is proposed in the present invention to gradually raise the average current level of the current supplied to the LED unit. This can be realised by raising the current supplied to the LED unit to the next available current level for only a comparatively small portion of a period of the rectified AC voltage. This small portion can e.g. correspond to T1=1/F whereby F represents the frequency at which a new current set-point can be provided to the LED driver. In case a new current set-point can e.g. be provided every 52 μsec, (T1=52 μsec), the average current over a period of the supply voltage could be incremented in very small steps by increasing the current during each period of the supply voltage only over a period equal to T1, rather than adjusting (raising or decreasing) the current profile entirely to a next current level. Phrased differently, the current as provided to the LED unit can e.g. have a staircase profile, ascending when the supply voltage increases and descending when the supply voltage decreases. The levels of the staircase would thus correspond to the available current levels. Instead of incrementing each level of the staircase profile with one level, the average level is gradually increased by increasing only one level (or part of one level, e.g. only during a period T1) of the staircase profile with one current level. By doing so, the resolution at which the average current can be varied is increased significantly, compared to a resolution solely based on the available number of current levels.

The LED driver according to the present invention thus enables the powering of a comparatively low number of LED units by an electronic transformer even if the average power to the LED units is lower than a minimum power requirement of the transformer. This facilitates the application of the LED driver according to the invention in retro-fit situation. It is further worth noting that the LED driver according to the invention may also be applied when the supply voltage is provided from a conventional magnetic transformer, which e.g. merely transforms a 230V, 50 Hz mains voltage to a suitable lower voltage by an inductive coupling. In case the supply voltage originates from a magnetic transformer, there is no need to perform the amplitude modulation and conventional current control can be applied by the LED driver. In such case, it may however still be advantageous to apply an energy storage element to avoid a visible flicker of the LED unit's light output. Therefore, in an embodiment, the LED driver according to the invention is arranged to detect what type of transformer (either a conventional transformer or an electronic transformer) is providing the supply voltage. This can e.g. be realised by applying a rapid current fluctuation (i.e. a comparatively large increase or decrease of the current provided to the LED unit) and monitoring the effect of such current fluctuation on the supply voltage. It has been devised by the inventors that the application of a rapid current fluctuation during either the ascending or descending slope of the supply voltage, can result in an electronic transformer ceasing to provide an output voltage. Because a conventional transformer is not or hardly affected by such a current fluctuation, distinction can be made between a conventional transformer and an electronic transformer providing the supply voltage.

The following figures provide further details of embodiments of the present invention whereby corresponding reference numbers indicate corresponding features.

DESCRIPTION

Figure 1:
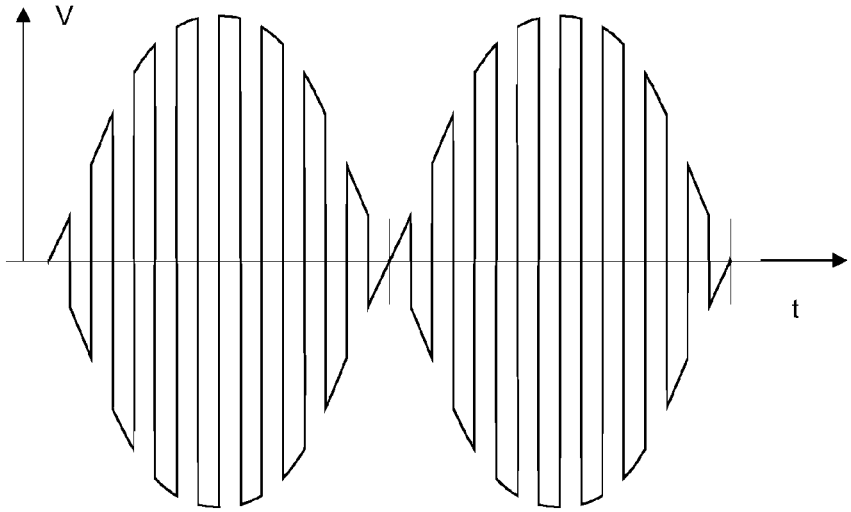
FIG. 1 schematically depicts an output voltage as can be obtained from an electronic transformer.
Figure 2:
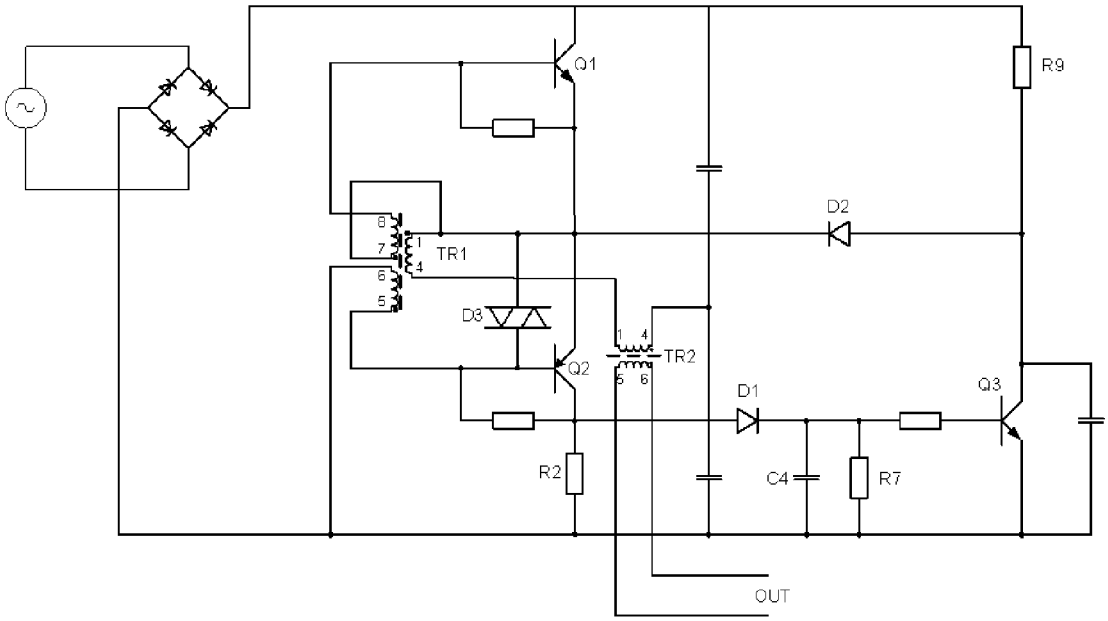
FIG. 2 schematically depicts an electronic transformer scheme.

At present, lighting applications such as halogen lights are often supplied from an electronic transformer or a conventional magnetic transformer. In the latter case, a mains input voltage (e.g. 230V, 50 Hz) is converted to a comparatively low voltage, e.g. 12V, 50 Hz. In case an electronic transformer is applied, a mains AC voltage (or a TRIAC dimmer output voltage) is modulated (e.g. at 50 or 60 kHz) to a voltage form as schematically shown in FIG. 1 which is scaled down to the appropriate voltage level using a transformer. Due to the high frequency content of the modulated voltage, the volume of the transformer can be reduced significantly, compared to a transformer operating at 50 or 60 Hz. FIG. 2 schematically depicts an electronic scheme of an electronic transformer as e.g. can be applied to provide a supply voltage to an LED driver according to the invention or can be applied in a conventional manner to e.g. supply one or more halogen lights. The electronic transformer e.g. comprises a transistor pair Q1, Q2 arranged to, in use, ensure that an alternating voltage (as e.g. shown in FIG. 1) is available at output terminal 'out' of the electronic transformer.

In order to remain providing a supply voltage (as e.g. shown in FIG. 1) at the terminal 'out' a minimum current should flow through the secondary winding (5-6) of transformer TR2. This current results in a proportional current in the primary winding (1-4). Because the primary winding is series connected with the primary winding (1-4) of transformer TR1 with two secondary windings (5-6 and 7-8) connected to resp. bases of the transistors Q1 and Q2, said transistors providing the oscillation, the voltage drop over the windings (5-6 and 7-8) will become too low when the current as supplied to the load becomes too low. As a result, transistors Q1 and Q2 will no longer switch and the oscillation will cease. As soon as the voltage over capacitor C4 (sustained during the oscillation via D1) has become sufficiently low due to a discharge over R7, Q3 will cease to conduct thereby forcing Q2 to conduct, via R9, D2, D3. When, at that time (i.e. when Q2 start to conduct), a sufficiently large current can flow, the oscillation will resume. Otherwise, it will extinct again. By Q2 starting to conduct, a voltage will appear over R2 which, via D1 is transferred to C4. Q3 will thus conduct thereby delaying a subsequent triggering of the oscillation over some time (typically 400-500 microsecond).

The output voltage can subsequently be rectified to obtain a rectified AC supply voltage which can be provided at an input terminal of an LED driver according to the invention. The rectifier providing the AC supply voltage may also be implemented as part of the LED driver.

Conventionally, the output voltage of the electronic transformer can be applied to supply a halogen light. In such a situation, in order to properly operate, the power rating of the electronic transformer should match the power requirements of the halogen light that is powered because, as is known to the skilled person, an electronic transformer requires a minimum load in order to keep providing an output voltage. As will be illustrated in the following figures, when a supply current of an electronic transformer drops below a certain value, the output voltage cannot be maintained and gradually reduces to zero. Subsequently, a start-up circuit of the electronic transformer (e.g. the circuit associated with the transistor Q3 as shown in FIG. 2) will attempt to resume proper operation. Such an attempt may e.g. occur, depending on the type of electronic transformer, every 0.5 ms. Once the load requirements for the electronic transformer are sufficient to sustain the output voltage, the electronic transformer will resume its proper operation.

In case of an LED based lighting application, the output voltage of the electronic transformer can be applied to supply a power converter of an LED driver. Examples of such power converters are Buck or Boost converters. In order for such an LED driver to power an LED unit, similar constraints with respect to load requirements have to be met, in order for the electronic transformer to keep providing a supply voltage to the power converter.

In accordance with the present invention, a strategy has been devised which enables an LED based lighting application having a power rating below the power rating of an electronic transformer, to be powered by such a transformer, substantially without any noticeable intensity variations. In order to achieve this, an embodiment of the LED driver according to the invention is controlled in such manner that a current can be supplied to a LED unit, essentially in an uninterrupted manner.

In case an LED driver or a power converter of an LED driver is supplied from a varying supply voltage such as a rectified AC-voltage or a voltage originating from an electronic transformer (optionally preceded by a TRIAC dimmer), it may be advantageous or even required to provide the LED driver with an energy storage element. Such an energy storage element can e.g. comprise one or more capacitors connectable or connected to the input terminals of the power converter of the LED driver. In such case, the one or more capacitors can be charged by the supply voltage when this voltage is comparatively high and discharged, thereby supplying the power converter of the LED driver, when the supply voltage is comparatively low.

Figure 3:
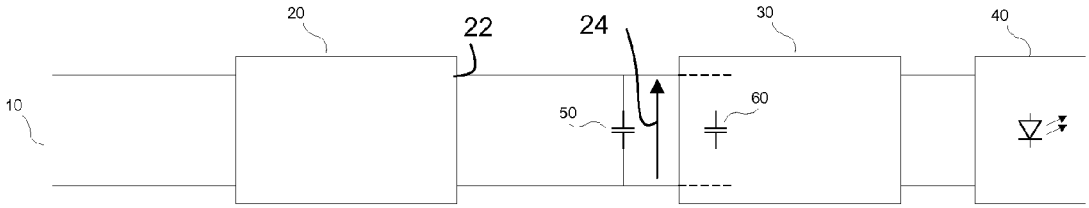
FIG. 3 schematically depicts a lighting application including an LED driver according to the invention.

FIG. 3 schematically depicts such an arrangement. In FIG. 3, reference number 10 refers to an AC supply voltage (e.g. a 230 V, 50 Hz mains supply voltage) which is applied as an input voltage for an electronic transformer 20. The electronic transformer 20 can be provided with a rectifier or can be followed by a rectifier (not shown) resulting in a rectified AC voltage at the output terminals 22. Note that the rectifier can also be provided as part of the LED driver. In order to filter high frequency components in the rectified AC voltage (e.g. due to the modulation of the AC supply voltage 10 by the electronic transformer 20), a filter capacitor 50 can be provided. As such, a filtered, rectified AC voltage can be obtained as a supply voltage 24 for an LED driver 30. As schematically shown, the LED driver 30 comprises a capacitor 60, which operates as an energy storage element. The capacitor 60 can e.g. be charged by the supply voltage 24 thus resulting in an additional voltage source which can be used for supplying the LED driver in case the supply voltage 24 is comparatively low. In an embodiment, the connection of the energy storage element 60 to the output voltage of the electronic transformer or the LED driver can be controlled. As an example, a (electronic) switch (not shown) can be provided in series with the energy storage element 60 whereby the switch can be opened when the capacitor 60 is charged and is subsequently closed in order to supply the LED driver, when the supply voltage 24 is low. In such an arrangement, a diode (not shown) can be connected between the output terminal 22 and the energy storage element to ensure that power can only be supplied to the LED driver. FIG. 3 further schematically shows an LED unit 40 being powered by the LED driver 30.

In order to ensure the operation of an electronic transformer providing a supply voltage, at least during part of the period of the supply voltage, the LED driver according to the present invention is arranged to draw a current from the supply voltage, the current being amplitude modulated in synchronism or in phase with the rectified AC supply voltage. This will be explained in more detail below. By applying an energy storage element such as the capacitor 60, the variation of the current as supplied to the LED unit (which could be noticed by some observers), can be mitigated. The use of such an energy storage element as a temporary supply source also enables the frequency content of the current as supplied to the LED unit to be raised. As an example, by appropriate switching of the switched capacitor (as is explained in more detail below) and thus applying the charged capacitor as a voltage source when the supply voltage is comparatively low, the current as supplied to the LED unit may have a main frequency component at twice the main frequency of the rectified AC voltage (i.e. a 200 Hz current component in case the rectified AC supply voltage originates from a 50 Hz mains voltage and thus has a main frequency component of 100 Hz).

In case a switchable storage element is used, the control unit of the LED driver can be arranged to control both the current as provided to the LED unit and the switching of the switchable storage element such that the total current as provided by the power supply (e.g. the sum of the load current of the storage element and the current provide to the LED unit) is synchronised or in phase with the rectified AC supply voltage.

As an alternative or in addition to the application of a switchable storage element, the load of the LED driver according to an embodiment of the invention as perceived by the electronic transformer providing the supply voltage, can gradually be raised thereby facilitating the proper operation of the electronic transformer. Gradually increasing the load as perceived by the electronic transformer e.g. be done by connecting one or more comparatively small capacitors as an additional load to the LED driver. In an embodiment, such an arrangement of e.g. n capacitors provided with a switch to selectively connect the capacitors can be integrated in the LED driver. In practice, a single electronic transformer is often applied to power a plurality of LED units (or LED drivers). It has been observed by the inventors that care should be taken not to add too much load to the LED driver or drivers, as this may cause damage to the electronic transformer. When the power drawn by the LED units (or the LED drivers powering the LED units) is too small, the output voltage of the electronic transformer can drop to zero. In order to sustain the output voltage of the transformer, the control unit of the LED drivers according to an embodiment of the invention can be arranged to increase the power consumption of the LED drivers, by adding an extra load. However, as it may be a-priori unknown how many LED drivers (say in a case: N) are powered from a single electronic transformer, the additional load may rise to N times the load which is minimally necessary for a particular type of electronic transformers to remain outputting power. This follows from the observation that such an additional load can only be determined at design-time of the LED driver. With certain types of load (f.e. capacitive loads), adding a comparatively high load may damage the electronic transformer, thus limiting N to only 1 or 2 nodes. By making the LED driver adapting to the situation, that is to the number of LED drivers N, a situation can be reached whereby only the bare minimum of additional load is added over the entire system (i.e. over all N LED drivers) to sustain the electronic transformer.

Assuming the additional load needed to keep the electronic transformer operating to be a capacitor of X nF. In case more than one LED unit is powered from the transformer, it may be sufficient to add to each lighting application a load which is only a fraction of X nF, namely substantially 1/N times X nF. As N is a priori unknown, it is proposed according to the invention, to gradually increase the additional load whereby an assessment is made whether the added load is sufficient, each time a load, e.g. X/Y nF is added. Each time a load is added, the electronic transformer will, as indicated above, attempt to output power again. In case the load of the transformer is insufficient, the transformer will cease to output power indicating that further additions of the load are required. As such, it may typically take a few periods before the total added load by the N LED drivers equals or exceeds the minimal extra load. As an example, assuming a minimal load requirement to be 15 nF whereby the load represented by each LED driver can be increased in steps of 2 nF during each period. In such a situation, it would take three periods to obtain or exceed the minimal load when 6 LED drivers are powered by the transformer. In case 10 LED drivers are powered, it would only take one period to obtain or exceed the minimal load. As soon as the minimal load required is added, the lighting applications can stop adding load. Using this approach, one can avoid that the total load to be powered by the electronic transformer increases to a level that would cause damage to the electronic transformer. As indicated above, the application of an additional load can be combined with the application of an LED current being amplitude modulated in phase with the rectified AC supply voltage. Due to the additional load, a smaller amplitude modulation may be applied to sustain the transformer during part of the supply voltage period, compared to the situation where no additional load is applied.

Figure 4:
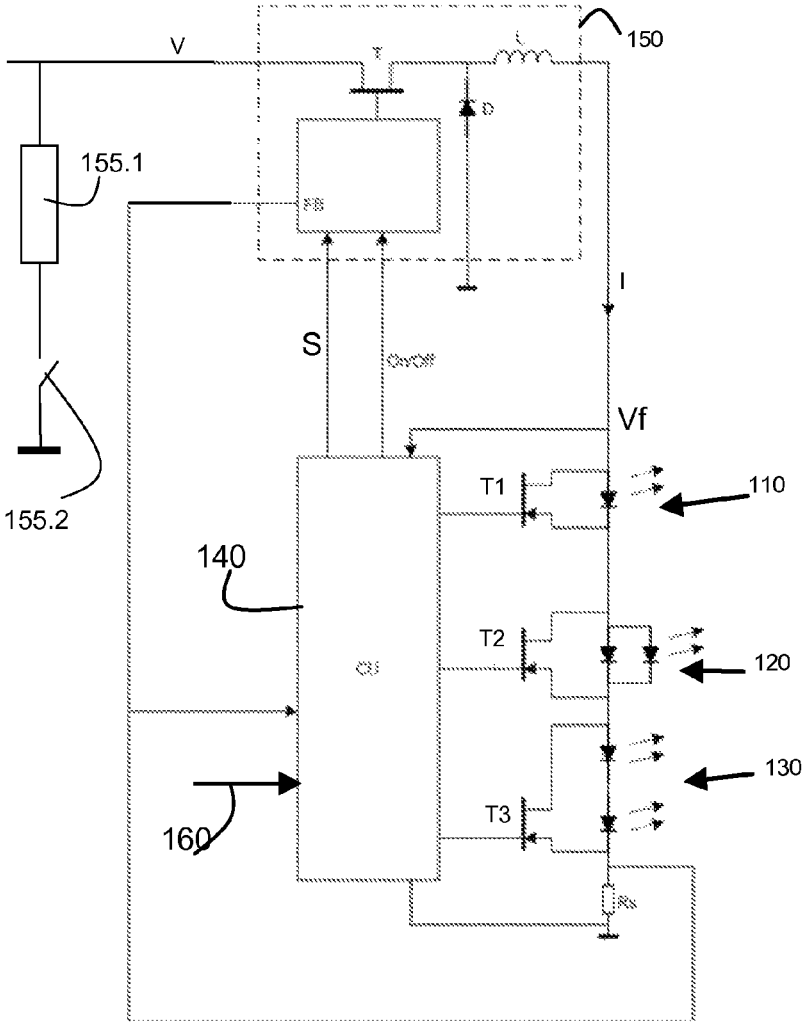
FIG. 4 schematically depicts an embodiment of an LED driver according to the invention.

An example of an LED unit being powered by an LED driver is schematically shown in FIG. 4. FIG. 4 schematically depicts an LED driver comprising a power converter 150 arranged to power an LED unit (110,120,130) and a control unit 140 arranged to control the power converter and, in the embodiment depicted, also the LED unit. The LED unit (110, 120,130) comprises a serial connection of three units 110, 120 and 130. The embodiment further comprises a switch assembly comprising three switches T1, T2 and T3 that can substantially short circuit the respective units 110, 120 and 130. The switches can e.g. comprise a FET or a MOSFET. FIG. 4 further depicts a power converter 150 for powering the LED units and a control unit 140 for controlling the power converter 150. The power converter can e.g. be, as shown in FIG. 4, a buck converter or can be another type of converter that enables the application of a current I to the LED unit. The power converter 50 is supplied from a voltage source V, e.g. a rectified AC voltage source obtained by rectifying an electronic transformer output voltage. In accordance with the invention, the control unit 140 is provided with a signal 160, the signal representing the supply voltage V that is provided to the converter 150. As further shown in FIG. 4, the control unit 140 can further be equipped to provide an On/Off signal to the converter 150 in order to turn the current source on or turn it off. In accordance with the invention, the control unit 140 is further arranged to control the power converter 150 by providing a control signal S to the power converter. The control signal can e.g. be applied by the power converter to control the switching element T of the converter thereby controlling the current I as supplied by the power converter to the LED unit. As such, the control signal can e.g. comprise a current set-point for the power converter whereby the power converter controls the duty cycle of the switching element in order to obtain the required current set point. In order to achieve this, a voltage over resistance Rs can be applied as a feedback to the control unit 40 and to the converter 150 (inputted at a terminal FB of the converter), the voltage representing the current through the LED unit and can thus be applied to control the switching element T of the converter, e.g. based on a difference between the required current (represented by the control signal S) and the actual current (represented by the voltage over resistance Rs). The LED driver as schematically shown in FIG. 4 further comprises a switchable storage element (or switchable energy storage element) connected to the rectified AC supply voltage. The switchable storage element comprises an energy storage element 155.1 (e.g. a capacitance or inductance) and a switch 155.2 controlled by the control unit 40, e.g. based on the signal 160 representing the rectified AC supply voltage.

In an embodiment, the energy storage element 155.1 may also function as a power factor correction device. In the embodiment as shown, this would thus result in a switchable power factor correction device. As an alternative, a static power factor correction device can be applied in combination with the switchable storage element as shown. Embodiments of a (switchable) power factor correction device are explained in more detail below.

Conventionally, the current I as supplied by the power converter to the LED unit or the LEDs of the LED unit is kept at a nominal value. In order to change an intensity of the light emitted, the duty cycle at which the current is provided, is changed, e.g. by operation of a switch in parallel with the LED unit or an LED of the LED unit (such as switches T1, T2 and T3) as shown in FIG. 4.

With respect to the application of an electronic transformer as a supply source for an LED driver (or a power converter of the LED driver), it has been devised, according to the invention, that such application can be facilitated by applying a varying current I to the LED unit. More specifically, it has been devised by the inventors that by applying an amplitude modulation to the current supplied, the amplitude modulation being in phase with the supply voltage (i.e. the rectified AC voltage), the proper operation of the electronic transformer can be more easily sustained. Within the meaning of the present invention, an amplitude modulation in phase with the supply voltage can be described as, but is not limited to:

The current as provided to the LED unit comprising a frequency component in phase with a main frequency component of the supply voltage. As an example, the current as provided to the LED unit can comprise a 100 Hz component in case the rectified AC supply voltage originates from a 50 Hz mains supply voltage, the 100 Hz current component being in phase with the main (100 Hz) component of the rectified voltage.

The current as provided to the LED unit comprising a frequency component in constant phase relationship with a main frequency component of the supply voltage. As an example, the current as provided to the LED unit can comprise a 200 Hz component in case the rectified AC supply voltage originates from a 50 Hz mains supply voltage, a peak of the 200 Hz current substantially coinciding with a peak of the rectified voltage.

The current as provided to the LED unit being above a certain level when the supply voltage is above a specific value or a specific percentage of the supply voltage peak value. As an example, the current as supplied to the LED unit can be block-shaped switching between a first, comparatively high, level (e.g. 120% of the nominal current) and a second, comparatively low, level (e.g. 20-30% of the nominal current), whereby the first current level is applied when the rectified AC supply voltage is above a specific value.

Figure 5:
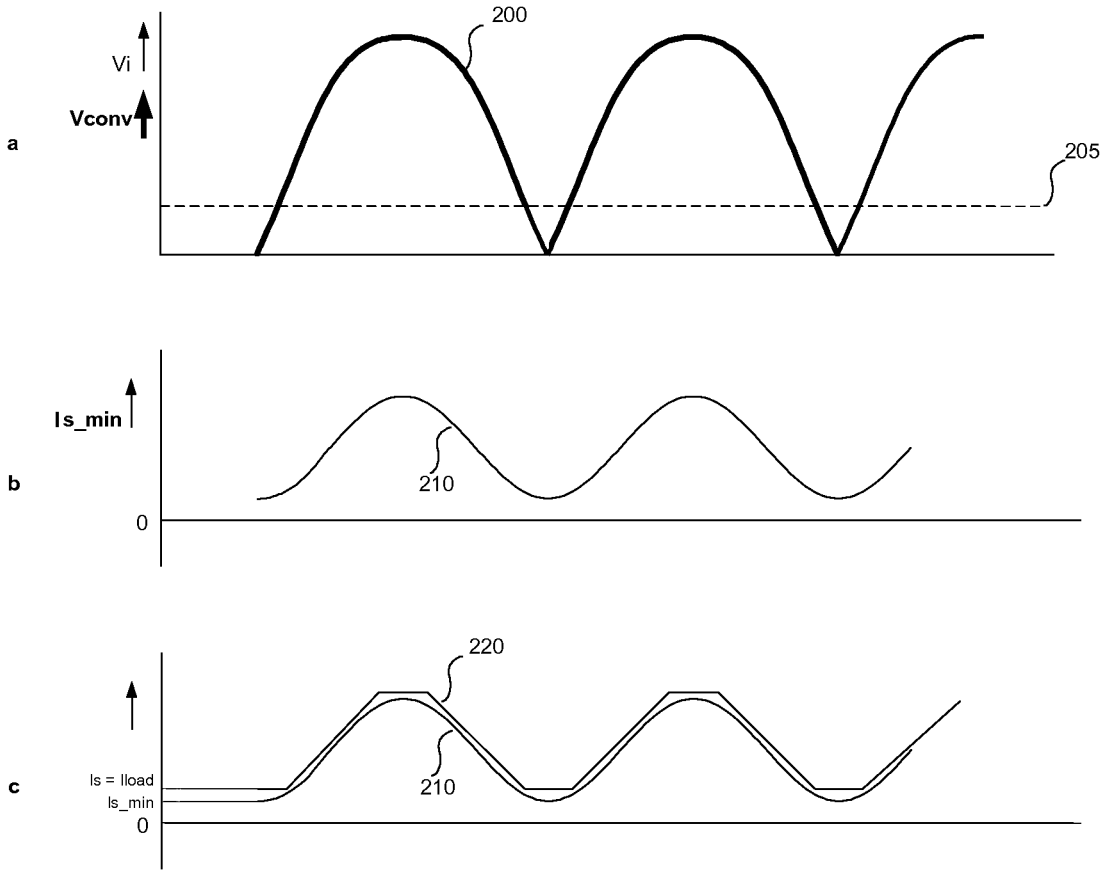
FIG. 5 schematically depicts a minimum current requirement in relationship with a supply voltage waveform as obtained from an electronic transformer.

FIG. 5 schematically illustrated a possible way of modulating the current supplied to the LED unit, in order to sustain the electronic transformer. FIG. 5 schematically depicts (graph a) a rectified AC voltage 200 as e.g. obtained as an output of an electronic transformer. Graph b schematically depicts a current profile 210 that enables, when such a current is drawn from the supply, the electronic transformer to maintain providing an output voltage. As such, this profile can also be described as a minimal required current for sustaining the transformer. In the example as shown in FIG. 5, the required minimal current 210 can be considered to vary proportional, or in phase, with the voltage 200 as supplied to the LED driver. In case the rectified AC voltage originates from a 50 Hz mains supply, the required current profile would thus comprise a 100 Hz component, 100 Hz also being the main frequency in the rectified AC voltage as provided to the LED driver. As can be seen when comparing both graphs a and b of FIG. 5, the minimum current required to sustain the electronic transformer is comparatively high when the supply voltage is high and can be comparatively low when the supply voltage is low. In order to realise such a current profile, the supply current Is to the LED unit can e.g. be controlled at a level above the nominal current (e.g. 120%) when the supply voltage is high and controlled to a level below the nominal current (e.g. 80%) when the supply voltage is low. Such a current profile 220 is schematically depicted in graph c of FIG. 5 together with the minimum current 210.

In accordance with the present invention, the current as provided to the LED unit need not necessarily be in phase with the rectified AC supply voltage, as it may be sufficient to synchronise the current as provide to the LED unit with the rectified AC supply voltage. By synchronising the current to the LED unit, the supply voltage (e.g. provided by an electronic transformer or a TRIAC dimmer) used as input for providing the rectified AC supply voltage can at least be sustained for a considerable part of a period of the supply voltage. As such, during a comparatively small part of the period of the supply voltage, the supply voltage may reduce to zero, the current to the LED unit thus being reduced to zero as well. For some application, having the LED current reduce to zero during a comparatively small part of the period of the supply voltage may be acceptable. In case this is not acceptable, an embodiment of the LED driver according to the invention is provided with an energy storage element (such as a capacitance) which can be used, as explained in more detail below, as a power supply for generating an LED current when the supply voltage is absent.

With respect to the required current profile as depicted in graph b of FIG. 5, it is worth mentioning that such a profile, in particular the low current portion of the profile, may be difficult, if not impossible, to realise when the supply voltage is low. In particular, in order to supply a current to an LED unit by an LED driver, a minimum input voltage needs to be available at the LED driver (the minimum voltage being related to the forward voltage requirements of the LED unit). This minimum voltage level is schematically indicated in graph a of FIG. 5 using reference number 205. As such, when the supply voltage 200 is less than the minimum voltage 205, the LED driver cannot supply a current to the LED unit. When no current is (temporarily) provided to the LED unit, the minimum current level 210 is not realised, consequently, the electronic transformer would cease to provide the supply voltage.

In order to overcome this, an energy storage element such as a capacitor can be applied in an embodiment of the LED driver according to the present invention, to supply the LED driver when the supply voltage is low. The application of an energy storage element is illustrated below using one or more capacitors. The same principles as explained below can however also be implemented when one or more inductances are applied as energy storage elements.

Figure 6A:
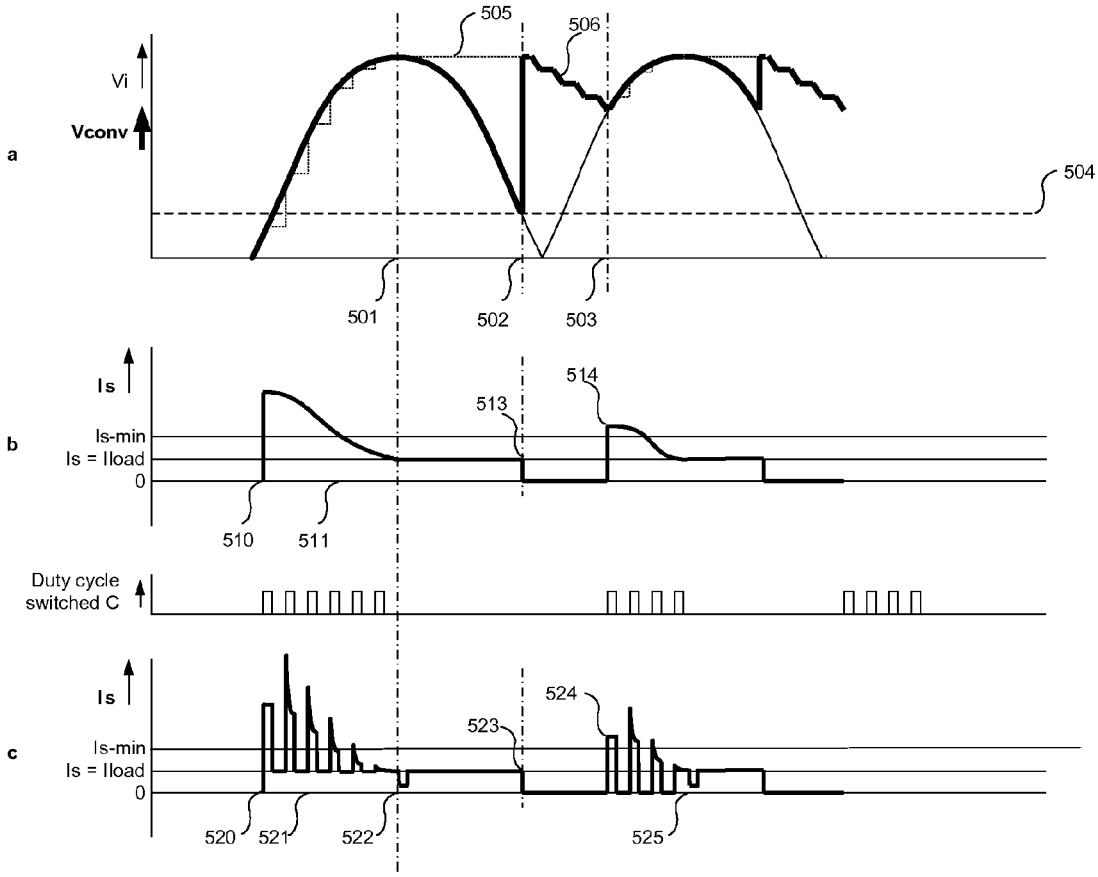
FIGS. 6*a*-6*b* schematically illustrate an operation of an LED driver according to the invention.

In order to charge the capacitor, different approaches can be applied, as illustrated in FIG. 6*a*. Graph a of FIG. 6*a* schematically shown (in solid thick line) the voltage as available at the input terminal of the LED driver when a capacitor is appropriately connected and disconnected to the supply voltage (i.e. a rectified AC voltage).

In an embodiment, the capacitor is charged in a continuous mode (see graph b) thereby connecting the capacitor to the input terminals (i.e. to the rectified AC supply voltage) until the capacitor is substantially charged. In such mode, the capacitor can e.g. remain connected to the supply voltage until the voltage reaches its maximum. At this point, the capacitor will be charged entirely and can be disconnected. By doing so, the capacitor remains charged to this maximum voltage. In graph b the capacitor is connected to the supply voltage from instance 510 and remains connected, e.g. until the supply voltage reaches its maximum value, instance 501. Graph b shows the supply current Is as drawn from the supply voltage. Is comprises a component Iload, the current as supplied to the LED unit and a component due to the charging of the capacitor. As from instance 502, the capacitor is reconnected and the available voltage (at a level 505) can be used to supply the load current to the LED unit. Consequently, the supply current Is can reduce to zero. At instance 503, the supply voltage becomes sufficiently high, compared to the voltage available at the capacitor, for the electronic transformer to restart and provide the supply voltage. As from that instance, the capacitor can be charged again.

In an embodiment, illustrated in graph c of FIG. 6*a*, the capacitor (or capacitors) is charged in a pulsed manner. By sequentially connecting the capacitor to the supply voltage for only a (very) short time, the capacitor is gradually charged by a number of current pulses which will, in general, have a comparatively high amplitude (due to the difference between the supply voltage and the capacitor voltage when using sufficiently small connection times) and can be used to sustain the electronic transformer even when the load current supplied to the LED unit is smaller than the minimum current requirement of the transformer. Graph c schematically depicts the current Is as drawn from the supply voltage comprising a component Iload, the current as supplied to the LED unit and a component due to the charging of the capacitor, i.e. a component consisting of a number of current pulses. The duty cycle at which the capacitor is connected and disconnected is schematically indicated above graph c.

Figure 6B:
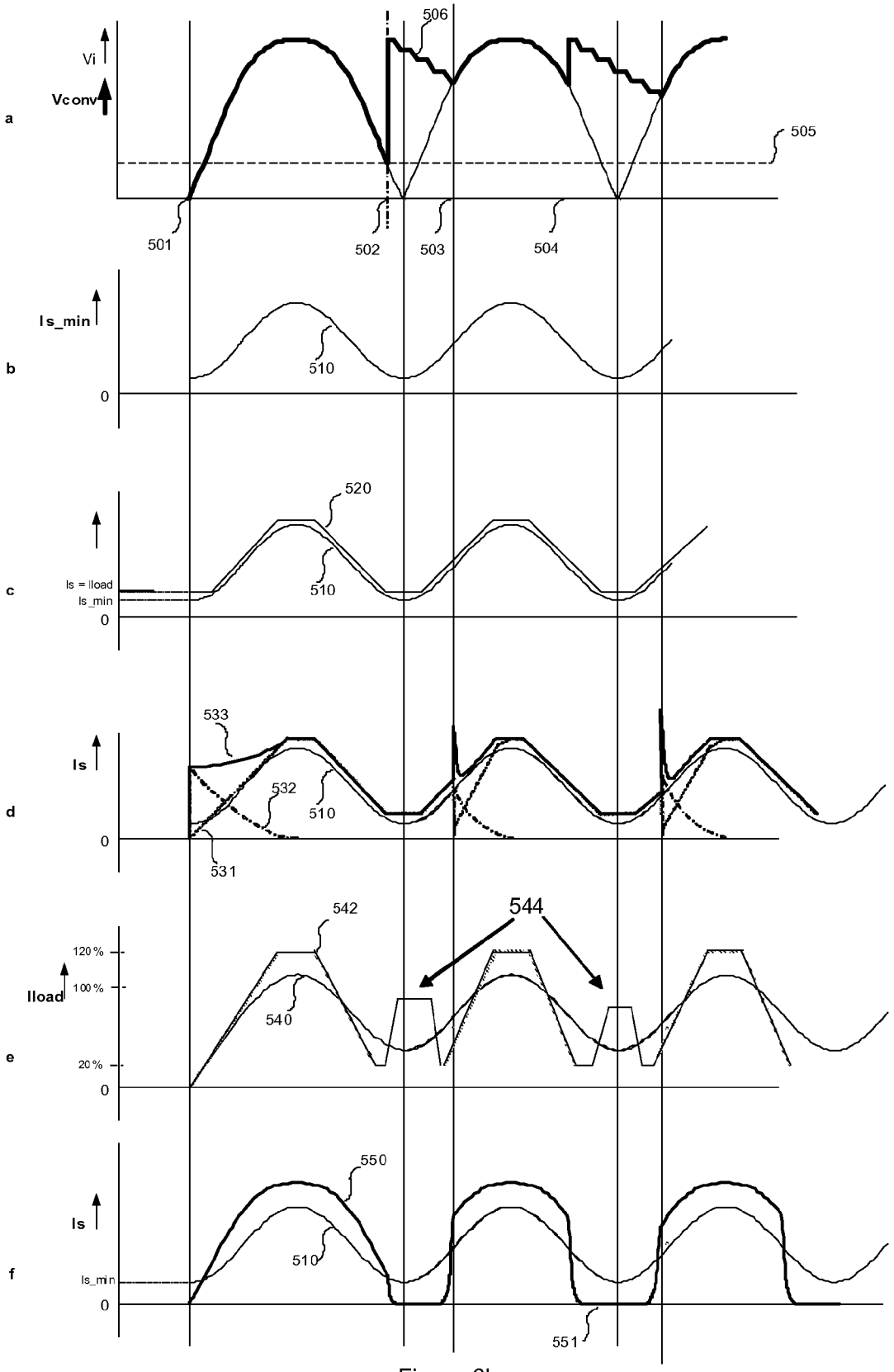

The operation of an embodiment of the LED driver according to the invention is further illustrated in FIG. 6*b*. The LED driver is assumed to be supplied from a rectified AC voltage originating from an electronic transformer at its input terminals. In the embodiment as shown, a switchable capacitor connectable between the input terminals of the LED driver (see further in e.g. FIG. 9) is further assumed, the capacitor thus being arranged to be charged from the rectified AC voltage from the electronic transformer. The capacitor can be used, when at least partly charged, to supply the LED driver.

In FIG. 6*b*, graph a (solid thick line) schematically depicts the voltage as can be supplied to the LED driver by properly charging and discharging the capacitor. During operating, a distinction can be made between the following operating modes, referred to as charge, run and boost. When operating in the charge mode, the capacitor is connected to the supply voltage such that it is charged by drawing a current from the electronic transformer. Such a connection can e.g. be established by closing a switch connected in series with the capacitor. Such a switch, e.g. a FET or a MOSFET, can be controlled by the control unit of the LED driver, e.g. based on a signal representing the supply voltage available at the input terminals. By having the capacitor charged by the electronic transformer, maintaining the supply current of the transformer above a minimum value is facilitated. As such, during the charging of the capacitor, the current as supplied to the LED unit can be lower than the minimum current while maintaining the electronic transformer operative.

When the capacitor is disconnected from the supply voltage, the LED driver is operated in the run-mode. During this mode, the LED unit is powered by the electronic transformer. In order to keep the electronic transformer providing the supply voltage, the current as supplied to the LED unit should thus be larger or equal to the minimum current. In order to realise this, the LED unit can be controlled to operate above its nominal current during this mode, i.e. during the run-mode. In general, the run-mode starts when the capacitor is disconnected from the supply voltage (this disconnection preferable occurs when the supply voltage is at its maximum value) and ends when the capacitor is reconnected.

When the capacitor is reconnected to the LED driver, the charged capacitor can be applied as a voltage source for powering the LED driver. This mode of operation is referred to as the boost-mode.

In an embodiment, the boost-mode is started when the supply voltage as provided by the electronic transformer to the LED driver is too low to power the LED unit. As will be understood by the skilled person, in order to supply a current to an LED unit, a minimum voltage equal to the required forward voltage of the LED unit needs to be available. Based on the topology of the LED unit and the specifications of the LED or LEDs applied, a control unit of the LED driver can determine the required minimal voltage that should be available at the LED driver input terminals in order to supply a current to the LED unit. When the available voltage would become insufficient to power the LED driver, the control unit of the LED driver can thus control the switch associated with the capacitor thereby connecting the charged capacitor to the input terminals of the LED driver. When operating in the boost-mode, e.g. starting from instance 502, the LED driver is supplied from the charged capacitor (in general, the energy storage element). Supplying the LED driver from the charged capacitor enables powering the LED driver and thus providing the LED unit with a current. Note that, in the absence of the charged capacitor, no power could be delivered to the LED unit when the supply voltage is below the required forward voltage (indicated by dotted line 505) of the LED unit. As such, no current would be drawn by the LED driver and the electronic transformer would cease providing the supply voltage. When the charged capacitor is applied to power the LED driver during the boost-mode, the electronic transformer will also cease to provide the supply voltage. However, such an interruption of the supply by the electronic transformer can remain unnoticed due to the power supply by the charged capacitor. As such, by applying an energy storage element as a supply source during part of the period of the rectified AC voltage (e.g. when the voltage is below a certain level), the electronic transformer need not be sustained during that part and can cease to provide an output voltage. When the electronic transformer has stopped providing an output voltage, the transformer will attempt, e.g. every 0.5 ms, depending on the type of transformer, to restore the output voltage again. Such attempt will fail however as long as the electronic transformer cannot supply a current to the LED driver. As long as the output voltage is smaller than the available voltage over the capacitor, an attempt to restart the transformer will thus fail. When the output voltage exceeds the voltage available at the capacitor, the electronic transformer can resume supplying a current to the load (i.e. the LED driver powering the LED unit) and to the capacitor, thereby charging the capacitor. In graph d of FIG. 6*b*, the charging current is indicated as 532, whereas 531 indicates the current to the LED unit, 533 indicates the sum of 532 and 531.

In practice, as indicated in graph e, a larger margin between the required current 540 and the actual current 542 supplied to the LED unit can be applied. When a sufficiently high supply voltage is available, the current supplied to the LED unit 542 can e.g. be above the nominal value (e.g. at 120%) and decrease below the nominal value at other instances. Similar to curve 531 of graph d, the current 542 comprises a component substantially in phase with the main frequency component of the rectified AC supply voltage (i.e. a 100 Hz component in case the supply voltage originates from a 50 Hz mains supply). In addition, current 542 comprises current peaks 544 occurring at times when the supply voltage is comparatively low, i.e. when the LED driver is supplied from the energy storage element. By doing so, a current component at twice the frequency of the main component of the rectified AC voltage (e.g. a 200 Hz component in case the supply voltage originates from a 50 Hz mains supply) is introduced. By doing so, adverse effects of the intensity variation of the LED unit can be mitigated.

Graph f finally describes the current Is as provided by the electronic transformer 550, together with the minimum current requirement 510. As can be seen, when the current 550 drops below the minimum current 510 (because the charged capacitor has taken over supplying the load current), the current rapidly drops to zero, due to the electronic transformer stopping. At times when the electronic transformer is not providing an output voltage, the LED driver can rely on the energy storage element (e.g. a charged capacitor or capacitors) to provide the required input power to supply a current to the LED unit.

Figure 7A:
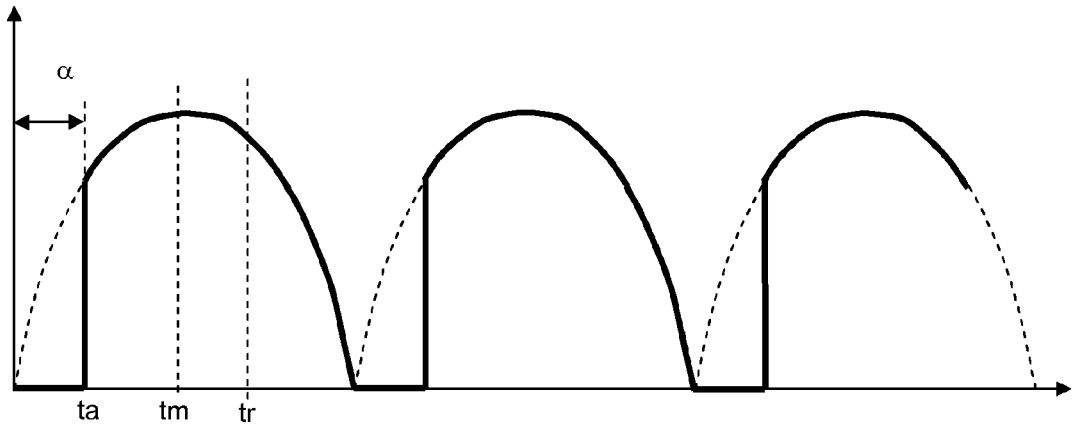
FIGS. 7*a* and 7*b* schematically illustrate an operation of an LED driver according to the invention when a TRIAC dimmer is applied for providing the supply voltage.

In order to synchronise the operation of a switch connecting or disconnecting a capacitor to the supply voltage, a reference instance can be determined relative to the period of the rectified AC voltage. The timing of the operation of the switchable energy storage element can then be controlled by the control unit, relative to the reference instance. Given the reference instance, the peak value of the supply voltage and frequency, the control unit can determine at each instance the available supply voltage and thus determine whether or not to operate the switchable energy storage element. As a reference instance, the control unit can e.g. determine (during a number of periods of the supply voltage), when the voltage is reduced by e.g. 3 or 5% compared to the peak value. This is schematically illustrated in FIG. 7*a* for a supply voltage that is phase angle modulated, e.g. by a TRIAC dimmer. In FIG. 7*a*, the dotted line 700 schematically indicates a rectified AC voltage whereas thick solid line 710 indicates a phase angle modulated (by phase angle α) AC voltage as can be obtained for a leading edge TRIAC dimmer. Also indicated in FIG. 7*a* is instance tm whereby the voltage 710 is at its maximum and instance tr (the reference instance), e.g. corresponding to a voltage that is 5% less than the maximum voltage. The reference instance that enables a synchronisation of the switching of an energy storage element, may also be applied to determine the phase angle modulation α when such a modulation is applied, e.g. by a TRIAC dimmer applying a leading or trailing edge phase modulation to the supply voltage or the mains voltage supplying the electronic transformer. The phase angle modulation α, can e.g. be determined from the reference instance tr and the instance at which the electronic transformer is successfully started again, corresponding to instance ta as indicated in FIG. 7*a*. In case of a leading edge dimmer, the instance ta could indicates the availability of a sufficiently high supply voltage, thus enabling the electronic transformer to power the LED driver. In case of a trailing edge dimmer, the instance to would correspond to the instance at which the electronic transformer stops providing an output voltage. Based upon the phase angle modulation thus determined, the control unit can control the average current as supplied to the LED driver thereby mimicking the conventional use of the dimmer.

Figure 7B:
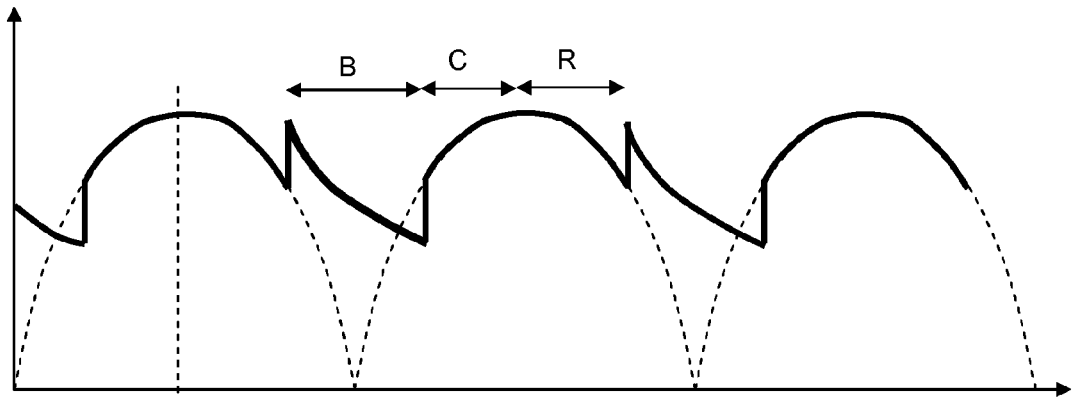

When a phase angle modulated supply voltage (as shown in FIG. 7*a*) is combined with the application of a switchable capacitor, a voltage profile as shown in FIG. 7*b* can be made available at the terminal of the LED driver. Such a profile can be realised, similar to the profile shown in graph a of FIG. 6*b*, by appropriate control of the switchable capacitor, thus operating in either the boost (B), run (R) or charge (C)-mode as described above. The obtained voltage profile can be applied by the LED driver to supply a current to the LED unit, whereby the current can be amplitude modulated as e.g. described above. As such, the current as provide to the LED unit can e.g. comprise or consist of a current component in phase with the main frequency component of the rectified supply voltage, or can comprise or consist of a component at twice the main frequency component of the rectified supply voltage.

Figure 8A:
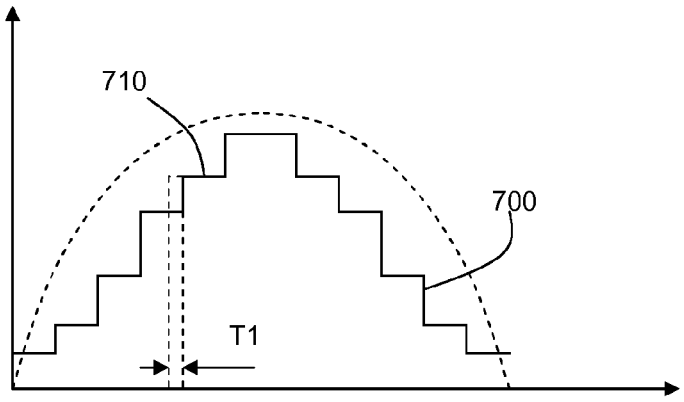
FIGS. 8*a* and 8*b* schematically indicate how to gradually increase the profile of the current as supplied to the LED unit.
Figure 8B:
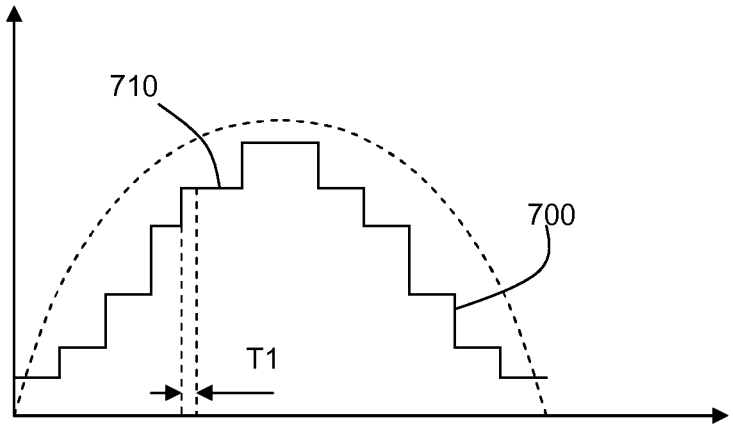

In an embodiment, the LED driver according to the invention is arranged to gradually increase the average current to the LED unit when an increase in the amplitude of the supply voltage is noticed. Such an increase can be due to load changes in the electric grid supplying an electronic transformer supplying the LED driver. Such change in the supply voltage amplitude is in general, a phenomenon that occurs on a comparatively large time scale (~minutes). A change in the amplitude of the available voltage may however affect the required current supplied to the LED unit in order to sustain the transformer. As such, the current supplied to the LED unit may need to be changed (e.g. increased) when the supply voltage changes (increases). In accordance with the invention, such an increase is done gradually, in order for the change in brightness (due to the change in current) to remain unnoticed to the observer. Assuming that a limited number of current levels is available that can be selected (e.g. 16 current levels ranging from zero to 120% of the nominal current). If the level of the current supplied to the LED unit would be raised by one level, such a change would become visible to an observer. In accordance with the invention, a gradual increase of the current is realised by raising the current supplied to the LED unit to the next available current level for only a comparatively small portion of a period of the rectified AC voltage. This small portion can e.g. correspond to T1=1/F whereby F represents the frequency at which a new current set-point can be provided to the LED driver, or a larger portion. In case a new current set-point can e.g. be provided every 52 μsec, (T1=52 μsec), the average current over a period of the supply voltage could be incremented in very small steps by increasing the current during each period of the supply voltage only over a period equal to T1, rather than adjusting (raising or decreasing) the current profile entirely to a next current level. This is illustrated in FIGS. 8*a* and 8*b*. In FIGS. 8*a* and 8*b*, graph 700 indicates the current profile as applied at a certain period of the supply voltage (indicated by the dotted line). In FIGS. 8*a* and 8*b*, period T1 as described above, is indicated. As can be seen when comparing FIGS. 8*a* and 8*b*, in order to gradually increase the current to the LED unit, the current is raised to the level indicated as 710 somewhat sooner (over a period T1 sooner), thereby realising an incremental increase in the average current (seen over one period) and thus resulting in an incremental increase in brightness which will remain unnoticed by an observer. This process can be repeated gradually, thereby effectively rendering the current profile somewhat wider and taller.

Figure 9:
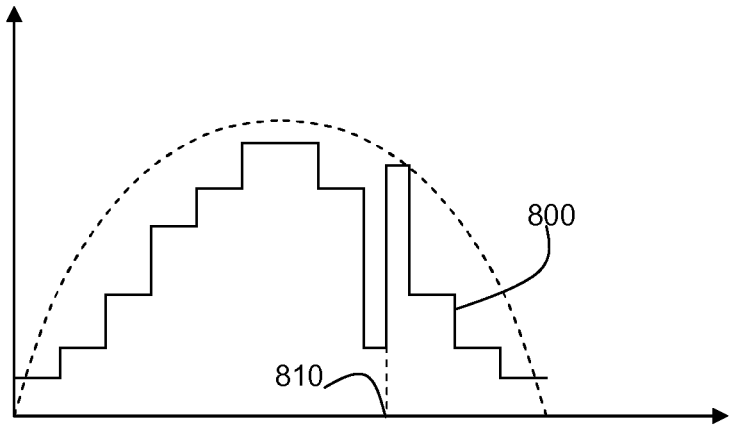
FIG. 9 schematically depicts a current profile as can be applied to determine whether or not an electronic transformer is providing the supply voltage.

With respect to the current profile as schematically depicted in FIGS. 8*a* and 8*b*, it can further be noted that such a profile can be characterised by the current slope being equal or larger than zero when the rectified AC voltage is ascending, the current slope being equal or smaller than zero when the rectified AC voltage is descending. It has been observed that applying such a profile further facilitates sustaining an electronic transformer supplying an output voltage. As such, it has also been determined by the inventors that the application of a current profile which does not comply with this characteristic (i.e. the current slope being equal or larger than zero when the rectified AC voltage is ascending, the current slope being equal or smaller than zero when the rectified AC voltage is descending), can trigger the electronic transformer to stop providing an output voltage. Therefore, in an embodiment of the present invention, the control unit of the LED driver is arranged to control the power converter of the LED to supply a current to the LED unit, the current comprising a rapid current fluctuation as e.g. shown in FIG. 9. The current profile 800 as shown in FIG. 9 comprises a current fluctuation on the descending part of the profile. As can be seen, the current profile 800 shows an increase in current at instance 810 rather than a decrease during the descending part of the rectified AC voltage. Applying such a profile can, as has been observed by the inventors, trigger an electronic transformer to stop supplying an output voltage. As such, applying such a profile enables the control unit to assess whether or not an electronic transformer is providing the supply voltage.

Referring to FIGS. 3 and 4 above, the LED driver according to the present invention can be provided with a power factor correction device. Such a device can e.g. be arranged at the input terminal of the LED driver and can be used to improve the power factor of the load (i.e. the power converter+LED unit of the LED driver).

Figure 10A:
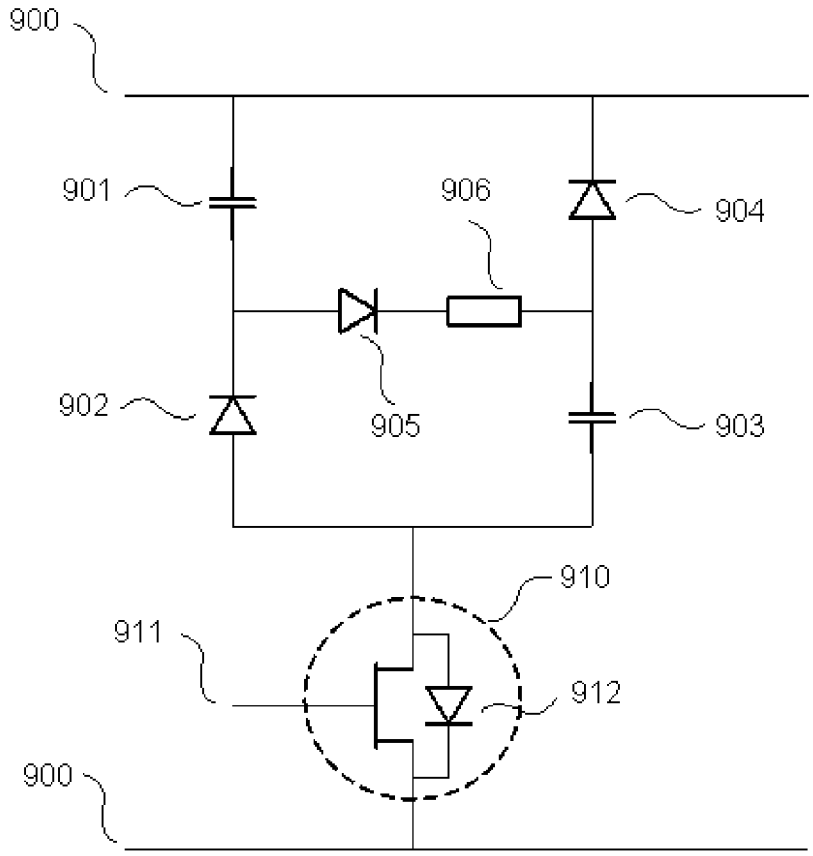
FIGS. 10*a*-10*c* schematically depict several embodiments of a power factor correction device as can be applied in an LED driver according to the invention.

In FIG. 10*a*, a first embodiment of a power factor correction device is schematically shown. The power factor correction device as shown in FIG. 10*a* comprises a capacitance network comprising capacitances 901 and 903 and further comprises diodes 902, 904 and 905 and an optional resistance 905. Reference numbers 900 denote the terminals between which the rectified AC supply voltage (e.g. voltage V of FIG. 4) is supplied. The power factor correction device can be connected/disconnected from the rectified AC supply voltage by controlling the gate 911 of electronic switch 910, e.g. a MOSFET having an internal diode 912. During operation, the capacitances 901 and 903 can be charged by the rectified AC supply voltage via diode 905. The capacitances thus being series connected during charging. Once charged, the capacitances can be discharged (capacitance 901 can be discharged via diode 902, capacitance 903 can be discharged via diode 904), by doing so, the capacitances are discharged in parallel.

Figure 10B:
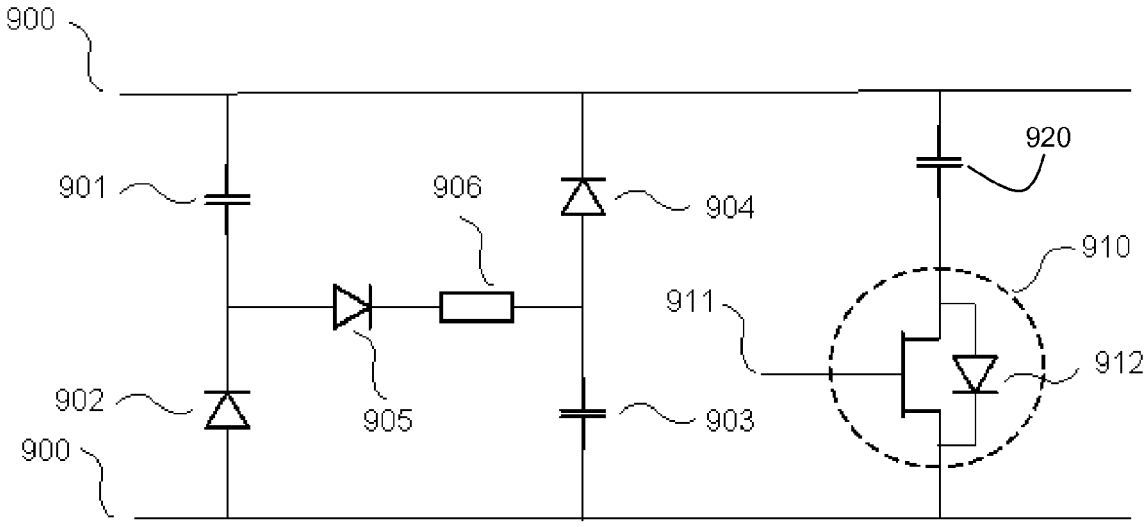

It is worth noting that the power factor correction device as shown may also be applied without the electronic switch 910, as schematically shown in FIG. 10*b*. In FIG. 10*b*, the power factor correction device as shown in FIG. 10*a* is shown in a static configuration, i.e. without the switch 910 connecting the device to the terminals 900. As such, the power factor correction device remains connected between the terminals at all times. In addition, FIG. 10*b* schematically shows a further capacitance 920 which can be used as an energy storage element which can be connected/disconnected to and from the terminals 900 by switch 910. The switch 910 as shown in FIGS. 10*a* and 10*b* can e.g. be controlled by the control unit of the LED driver according to the invention in order to connect and disconnect the power factor correction device or capacitance 920 at the appropriate instances, which can e.g. be derived from a supply signal, representing the rectified AC supply voltage, that is provided to the control unit.

Figure 10C:
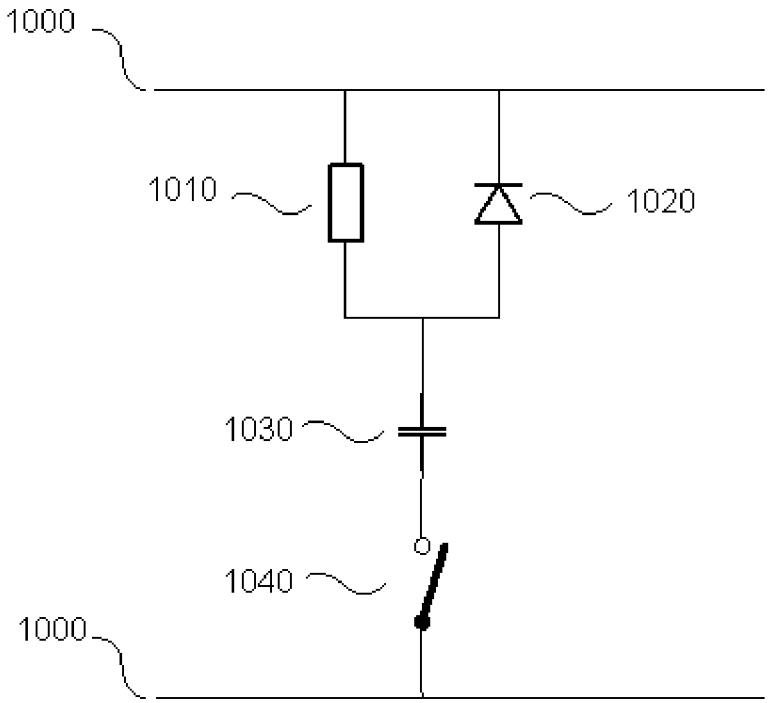

In FIG. 10*c*, another embodiment of a power factor correction device is schematically depicted, the device being connected between terminals 1000 representing the rectified AC supply voltage. In the embodiment, the power factor correction device comprises a capacitance 1030 that is series connected to a parallel arrangement of resistance 1010 and diode 1020. The device may in a controlled manner be connected and disconnected by switch 1040, e.g. an electronic switch such as a FET or MOSFET. During operation, capacitance 1030 can be charged via resistance 1010, while discharging can take place via diode 1020. As an alternative to the parallel arrangement of the resistance 1010 and diode 1020, the power factor correction device may comprise a current source or inductance arranged in series with the capacitance 1030.

With respect to the use of a power factor correction device as described above, it can be mentioned that the application of such a device can result in the LED driver operating at an improved power factor. The application of such a device may however also be considered as it can allow the profile of the current to the LED unit to be altered. In the absence of a power factor correction device, particular requirements can be posed upon the current profile in order to obtain a power factor that is sufficiently high; as an example, it may be required to have a sufficiently large current component in phase with the supply voltage. By using a power factor correction device, the requirements for the current profile can become less strict which can result in an improved illumination quality; e.g. less flicker.

It should further be mentioned that the embodiments of the LED drivers as described are mere illustrations of the various aspects of the invention, the invention only being limited by the scope of the claims as set forth.

The invention claimed is:

1. An LED driver comprising:

a power converter for powering an LED unit;

a control unit for controlling the power converter;

the power converter comprising:

an input terminal for receiving a rectified AC supply voltage, and an output terminal for supplying a current to the LED unit, the control unit comprising an input for receiving a supply signal representative of the rectified AC supply voltage received by the input terminal of the power converter, and an output for providing a control signal to the power converter, whereby the control unit is arranged to:

determine the control signal for controlling the power converter based on the supply signal, and control the power converter to supply the current to the LED unit based on the control signal, the current being amplitude modulated in phase or in synchronism with the rectified AC supply voltage, wherein a peak value of the current is, in use, varied according to the amplitude of the rectified AC supply voltage, whereby the variation is applied gradually by only adjusting a current level during a comparatively small part of a period of the rectified AC supply voltage per period of the rectified AC supply voltage.

2. The LED driver according to 1 further comprising a rectifier arranged to receive an AC supply voltage and provide the rectified AC voltage to the input terminal.

3. The LED driver according to claim 1, further comprising an energy storage element connectable by a switch to the input terminal.

4. The LED driver according to claim 3, whereby the energy storage element comprises a capacitor.

5. The LED driver according to claim 1 further comprising: an energy storage element; and a first switch for connecting and disconnecting the energy storage element to the input terminal, the first switch being controlled by the control unit, based on the input signal.

6. The LED driver according to claim 4, wherein the control unit is arranged to operate the driver in a first mode, thereby charging the capacitor from the rectified AC supply voltage; and in a second mode, thereby discharging the capacitor and providing a capacitor discharge current to the power converter for, at least partly, supplying the LED unit.

7. The LED driver according to claim 6 wherein the capacitor is charged in a pulsed mode.

8. The LED driver according to claim 7 wherein the capacitor comprises a plurality of capacitors that are sequentially charged.

9. The LED driver according to claim 1, wherein the control signal represents a current set point to be followed by the power converter, the current set point being amplitude modulated based on the supply signal.

10. The LED driver according to claim 5 wherein the energy storage element is arranged to supply the power converter when the rectified AC supply voltage is comparatively low.

11. The LED driver according to claim 1, wherein the peak value of the current is varied proportionally to the amplitude.

12. The LED driver according to claim 1 wherein the current comprises a staircase profile.

13. The LED driver according to claim 1 wherein the control unit is arranged to control the power converter to apply a current fluctuation during an ascending part or a descending part of the rectified AC supply voltage in order to detect whether or not the supply voltage originates from an electronic transformer.

14. The LED driver according to claim 2 wherein the AC supply voltage is provided by an electronic transformer or a TRIAC dimmer.

15. The LED driver according to claim 1 whereby the rectified AC supply voltage is phase angle modulated by a TRIAC dimmer.

16. The LED driver according to claim 15 whereby the control unit is arranged to determine a phase angle of the phase angle modulation of the TRIAC dimmer from the supply signal and whereby the control signal for controlling the power converter is based on the phase angle.

17. The LED driver according to claim 1 wherein the control unit is arranged to control the power converter to gradually reduce the amplitude modulation applied to the current and monitor if the supply voltage is sustained, and if the supply voltage is no longer sustained, gradually increase the amplitude modulation until the supply voltage is sustained again.

18. The LED driver according to claim 1, further comprising a power factor correction device connectable to the input terminal, wherein the power factor correction device comprises a capacitor circuit comprising a first and second capacitor, wherein the first and second capacitor are arranged to be charged in series and discharged in parallel.

19. Method of powering an LED unit by an LED driver, the method comprising the steps of:

a. providing a rectified AC supply voltage to an input terminal of a power converter of the LED driver;

b. receiving a supply signal representative of the supply voltage at an input of a control unit of the LED driver;

c. determining a control signal for controlling the power converter based on the supply signal; and d. controlling the power converter to supply a current to the LED unit based on the control signal, which current flows through the LED unit, whereby the current is amplitude modulated in phase with the rectified AC supply voltage, wherein a peak value of the current is, in use, varied according to the amplitude of the rectified AC supply voltage, and whereby the variation is applied gradually by only adjusting a current level during a comparatively small part of a period of the rectified AC supply voltage per period of the rectified AC supply voltage.

* * * * *